US008123533B2

(12) United States Patent
Luo et al.

(10) Patent No.: US 8,123,533 B2
(45) Date of Patent: Feb. 28, 2012

(54) ELECTRICAL CONNECTOR SAVING DEVELOPMENT OF MOLD

(75) Inventors: Yu Luo, Shenzhen (CN); Bo Yan, Shenzhen (CN); Wei Yuan, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/890,728

(22) Filed: Sep. 27, 2010

(65) Prior Publication Data

US 2011/0076893 A1 Mar. 31, 2011

(30) Foreign Application Priority Data

Sep. 29, 2009 (CN) ..... 2009203 1 1831
Jan. 25, 2010 (CN) ..... 20102030 1 385

(51) Int. Cl.
*H01R 9/00* (2006.01)

(52) U.S. Cl. ..... 439/79; 439/567
(58) Field of Classification Search ..... 439/79, 439/567
See application file for complete search history.

(56) References Cited

U.S. PATENT DOCUMENTS 5,080,596 A * 1/1992 Viselli et al. ..... 439/79
(Continued)

*Primary Examiner* — Gary F. Paumen
(74) *Attorney, Agent, or Firm* — Wei Te Chung; Andrew C. Cheng; Ming Chieh Chang

(57) ABSTRACT

An electrical connector has an insulative housing defining a mating portion defining a front surface and a back surface opposite to the front surface. A plurality of contacts is secured in the housing and define soldering tails. The contacts include a group of first contacts. A spacer is assembled to position the soldering tails and comprises first mounting holes to be inserted with the soldering tails of the first contacts. The first mounting holes of the spacer are lined in at least two rows and each row has a same number of the first mounting holes to a total number of the first contacts.

14 Claims, 8 Drawing Sheets

U.S. PATENT DOCUMENTS 6,077,092 A * 6/2000 Chiu et al. ..... 439/79
6,447,307 B1 * 9/2002 Wu ..... 439/79
6,478,603 B1 * 11/2002 Wu ..... 439/378
6,619,968 B2 * 9/2003 Xu ..... 439/79
7,611,362 B2 * 11/2009 Lin ..... 439/79
7,699,626 B2 * 4/2010 Lu et al. ..... 439/79
7,699,627 B2 * 4/2010 Xiang et al. ..... 439/79
2005/0054223 A1 * 3/2005 Zu et al. ..... 439/79

* cited by examiner

ELECTRICAL CONNECTOR SAVING DEVELOPMENT OF MOLD

BACKGROUND OF THE INVENTION

1. Field of the Invention

The present invention generally relates to an electrical connector, and more particularly, to a novel structure of a spacer of the electrical connector for saving development of the mold.

2. Description of Related Art

An electrical connector includes a plurality of elements that are needed to develop many molds for forming the elements, so the cost of the electrical connector is increased. If one element of the electrical connector is changed, the cost of the mold for forming the element is also increased. So the decrease of cost of molds for forming the elements is imperative.

An electrical connector includes an insulative housing, a plurality of contacts secured in the insulative housing and a spacer secured on the back of the insulative housing for retaining the contacts. Each contact has a contacting portion receiving in the insulative housing, a soldering portion extending outside the insulative housing for inserting through the spacer and a connecting portion connecting with the contacting portion and the soldering portion. The contacts include an array of first contacts whose the contacting portions are on a same line and adjacent soldering portions are arranged in two lines. The spacer includes a plurality of mounting holes for holding the soldering portions. The adjacent mounting holes are also arranged in two lines corresponding to the soldering portions of the first contacts. If the soldering portions of the first contacts are arranged in different sequence from what's it said, the mounting holes of the spacer also need to be changed corresponding to the soldering portions. The cost of mold for forming the spacer is increased. Thus, an electrical connector with saving development of the mold is desired to overcome the disadvantages of the related art.

Hence, the present invention is directed to solving this problem in the related art.

SUMMARY OF THE INVENTION

An object of the invention is to provide an electrical connector which has an universal space corresponding to different sequences of the soldering tails with saving development of the mold for forming the spacer.

In order to achieve the object set forth, an electrical connector has a insulative housing defining a mating portion defining a front surface and a back surface opposite to the front surface. A plurality of contacts is secured in the housing and define soldering tails. The contacts include a group of first contacts. A spacer is assembled to position the soldering tails and comprises first mounting holes to be inserted with the soldering tails of the first contacts. The first mounting holes of the spacer are lined in at least two rows and each row has a same number of the first mounting holes to a total number of the first contacts.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
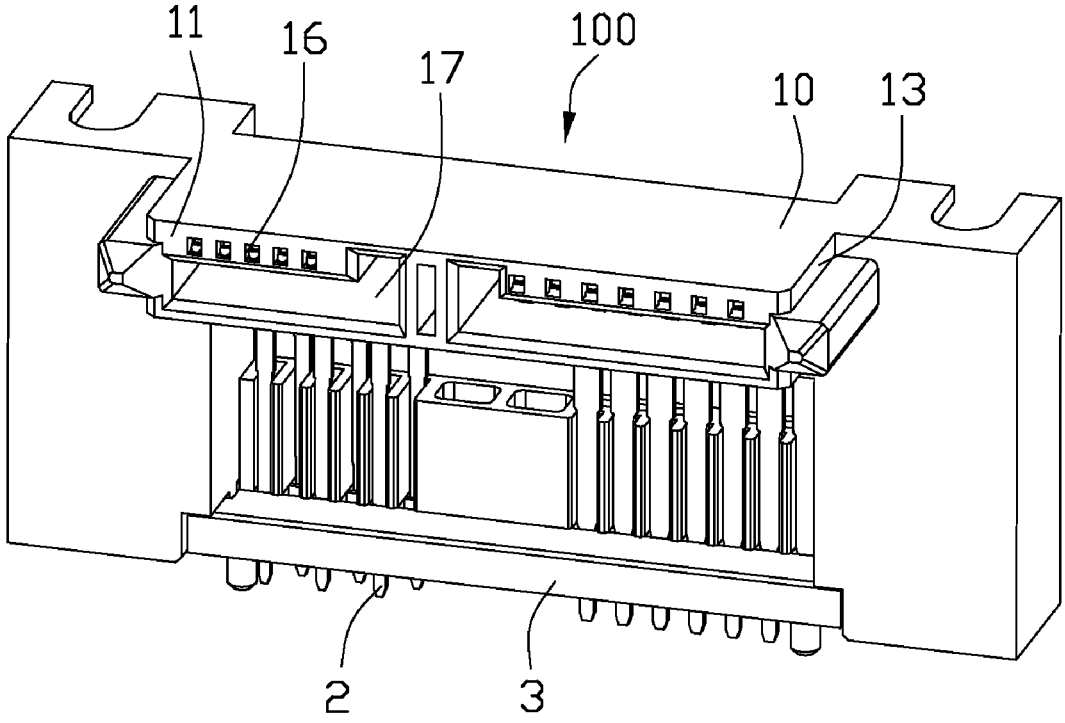
FIG. 1 is an assembled perspective view of an electrical connector of a first embodiment of the present invention.
Figure 2:
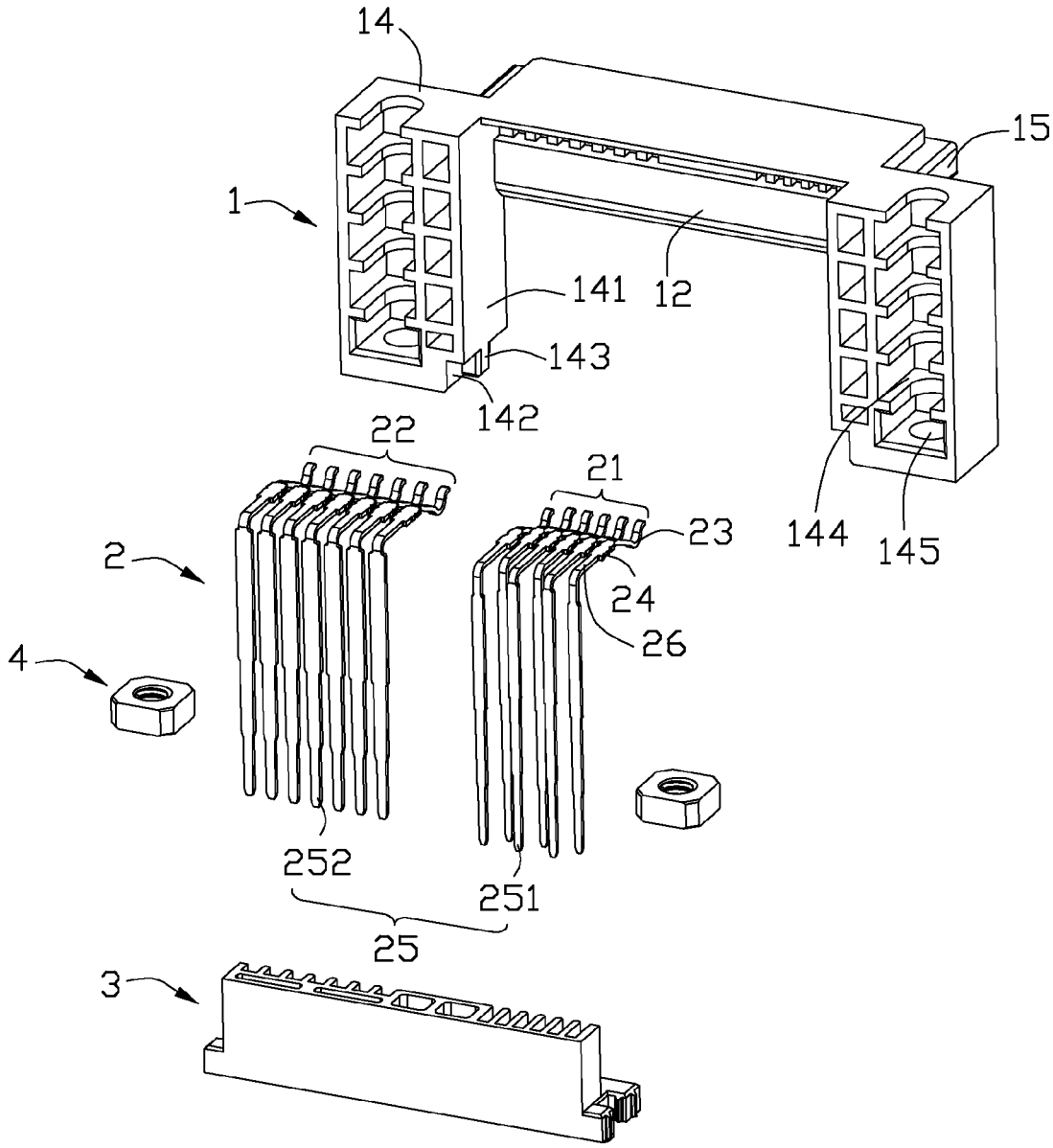
FIG. 2 is an exploded perspective view of the electrical connector as shown in FIG. 1.

Referring to FIGS. 1 and 2, an electrical connector 100 adapted for mounting on a printed circuit board (not shown) in accordance with a first embodiment of the present invention comprises an insulative housing 1, a plurality of contacts 2 secured in the insulative housing 1 and a spacer 3 for retaining the contacts 2.

Referring to FIGS. 1 and 2, the high-rise insulative housing 1 includes a mating portion 10 having a front surface 11 for mating a complementary connector (not shown) and a back surface 12 opposite to the front surface 11. A pair of mounting portion 14 extends downwardly at the two back end of the mating portion 10 and defines a bottom face 140 (labeled in FIG. 4) for mounting on the printed circuit board, respectively. There is obvious distance between the bottom face 140 and the mating portion 10, so the pair of the mounting portions 14 is functioned as a stand-off The mating portion 10 defines a pair of side surfaces 13 connecting with the front surface 11 and the back surface 12. A pair of guiding portions 15 extends forwardly from the side surface 13 and is located in front of the two mounting portions 14 to avoid mismating of the electrical connector 100. The mating portion 10 defines a plurality of receiving passageways 16 extending through the front surface 11 and the back surface 12 and two L-shaped slots 17 below the receiving passageways 16 and communicated with the receiving passageways 16.

Referring to FIGS. 2, a plurality of contacts 2 include an array of first contacts 21 and an array of second contacts 22 respectively secured in the receiving passageways 16 and exposing to said two L-shaped slots 17, respectively. Each contact includes a contacting portion 23 extending to the front face 11, a soldering tail 25 extending outside the receiving passageway and parallel to the back surface 12 and a connecting portion 26 connecting with the contacting portion 23 and the soldering tail 25 and defining a retained portion 24 retained in each receiving passageway. All the contacting portions 23 of the contacts receiving the receiving passageways are on a same line in longitudinal direction of the mating portion 10. The first soldering tails 251 of the first contacts 21 are arranged in a plurality of lines along a front to back direction perpendicular to the longitudinal direction, for example the first soldering tails 251 are arranged in two lines along the front to back direction in the embodiment. The adjacent first soldering tails 251 of the first contacts 21 are located at different lines. The second soldering tails 252 of the second contacts 22 are on a same line in longitudinal direction. The soldering tails 25 are arranged for matching traces printed on the printed circuit board.

Figure 3:
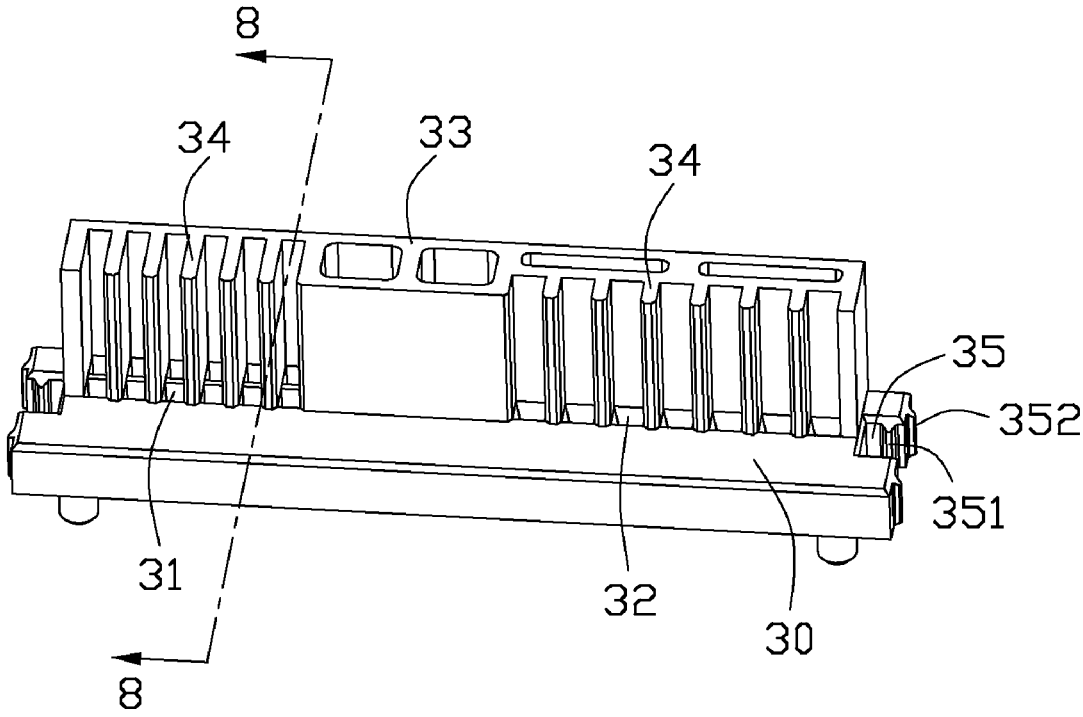
FIG. 3 is a perspective view of a spacer of the electrical connector as shown in FIG. 1.

As shown in FIG. 1, the spacer 3 are assembled between the two mounting portions 14 to support the soldering tails. Referring to FIGS. 3, the spacer has a base 30 defining a plurality of first mounting holes 31 and a plurality of second mounting holes 32 both arranged along longitudinal direction. The spacer 3 further has a baffle 33 extending upwards from the base to be parallel to the soldering tails 25 of the contacts 2. A plurality of parallel separators 34 aligned with the mounting holes extend forwardly from the baffle 33 for separating the adjacent soldering tails 25. A pair of recesses 35 is defined at the two ends of the base 30 with a pair of first engaging portions 351 at two insides thereof and a pair of second engaging portions 352 at two outsides of the base. Correspondingly as shown in FIG. 2, each mounting portion 14 of the insulative housing 1 defines a pair of cutouts 142 recessed at an inner face 141 thereof and running through the bottom face 140 partitioned by a tuber 143. Thus after the spacer 3 are assembled to the housing from the bottom face 140, the two first engaging portions 351 interfere with two opposite inside faces of the tuber 143 and the two second engaging portions 352 interfere with the inner face of the cutout 142.

Figure 4:
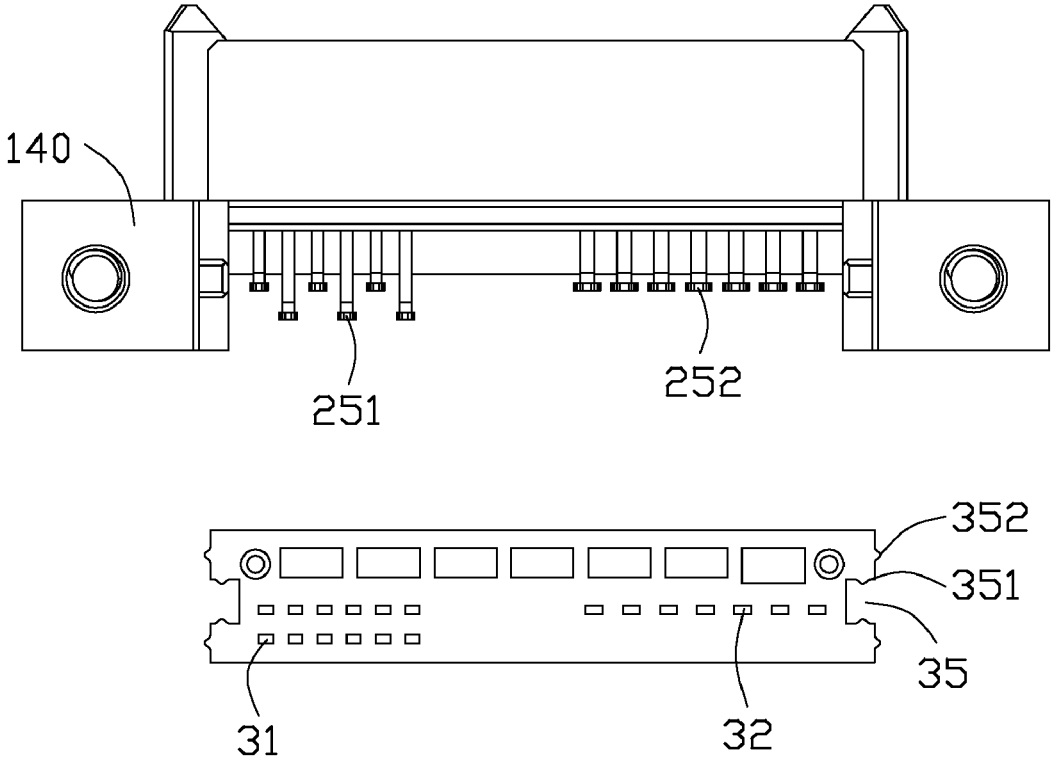
FIG. 4 is a bottom plane view of the exploded electrical connector as shown in FIG. 1.

Please notes to FIG. 4, the first soldering tails 251 and the second soldering tails 252 intend to be inserted to the first mounting holes 31 and the second mounting holes 32, respectively. The second mounting holes 32 are lined in one row, with seven holes in the first embodiment which equals to the second soldering tails 252 also in one row. The first mounting holes 31 are lined in two rows and each row has a number equal to the number of the first contact, i.e., the number of the total first mounting holes doubles that of the soldering tails of the first contacts. As a result, the spacer 3 is used to position the first soldering tails of two rows as clearly shown in FIG. 4 and the spacer also can be used to position the first soldering tails which are arranged in one row, without any amendment. The spacer can be used in different situations, which will omit re-development mold.

Referring to FIGS. 2, the electrical connector 100 also includes a pair of securing elements 4 respectively receiving in the two mounting portions 14 of the insulative housing 1 for assisting the housing 1 to be mounted on the printed circuit board. Each mounting portion 14 defines a plurality of mounting recesses 144 stacked up and down and communicated with each other for receiving the securing element 4. One of the mounting recesses 144 adjacent to the bottom face 140 defines a hole 145 extending through the bottom face 140. When the height of the insulative housing 1 is changed, the connection force between the mounting portion 14 and the printed circuit board will change and the height of the securing element 4 need to adjust by receiving the different heights of the mounting recesses 144.

Figure 5:
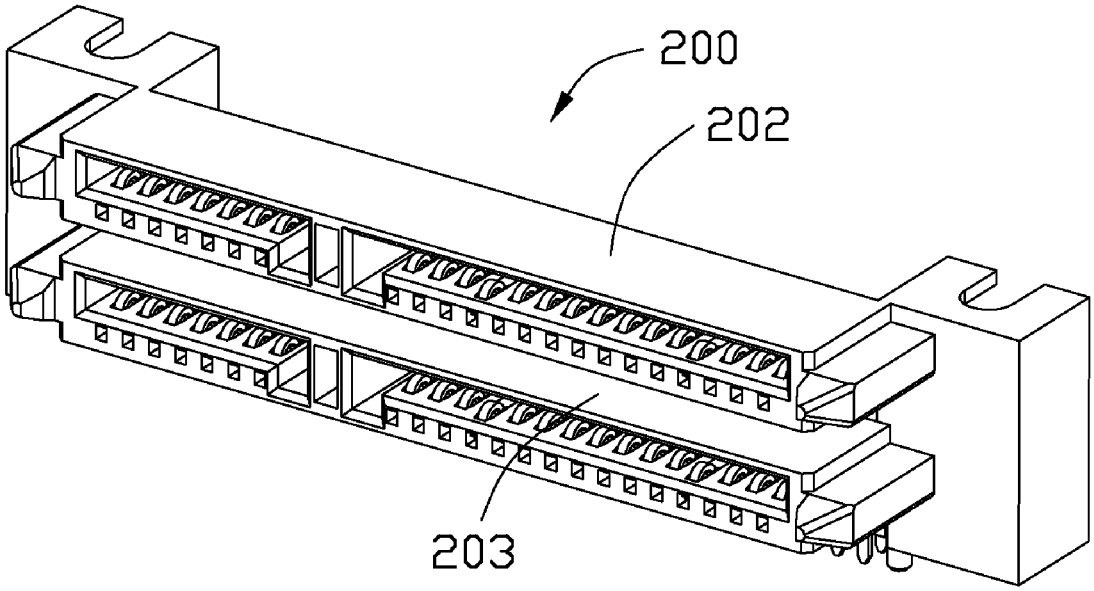
FIG. 5 is an assembled perspective view of an electrical connector of a second embodiment of the present invention.
Figure 6:
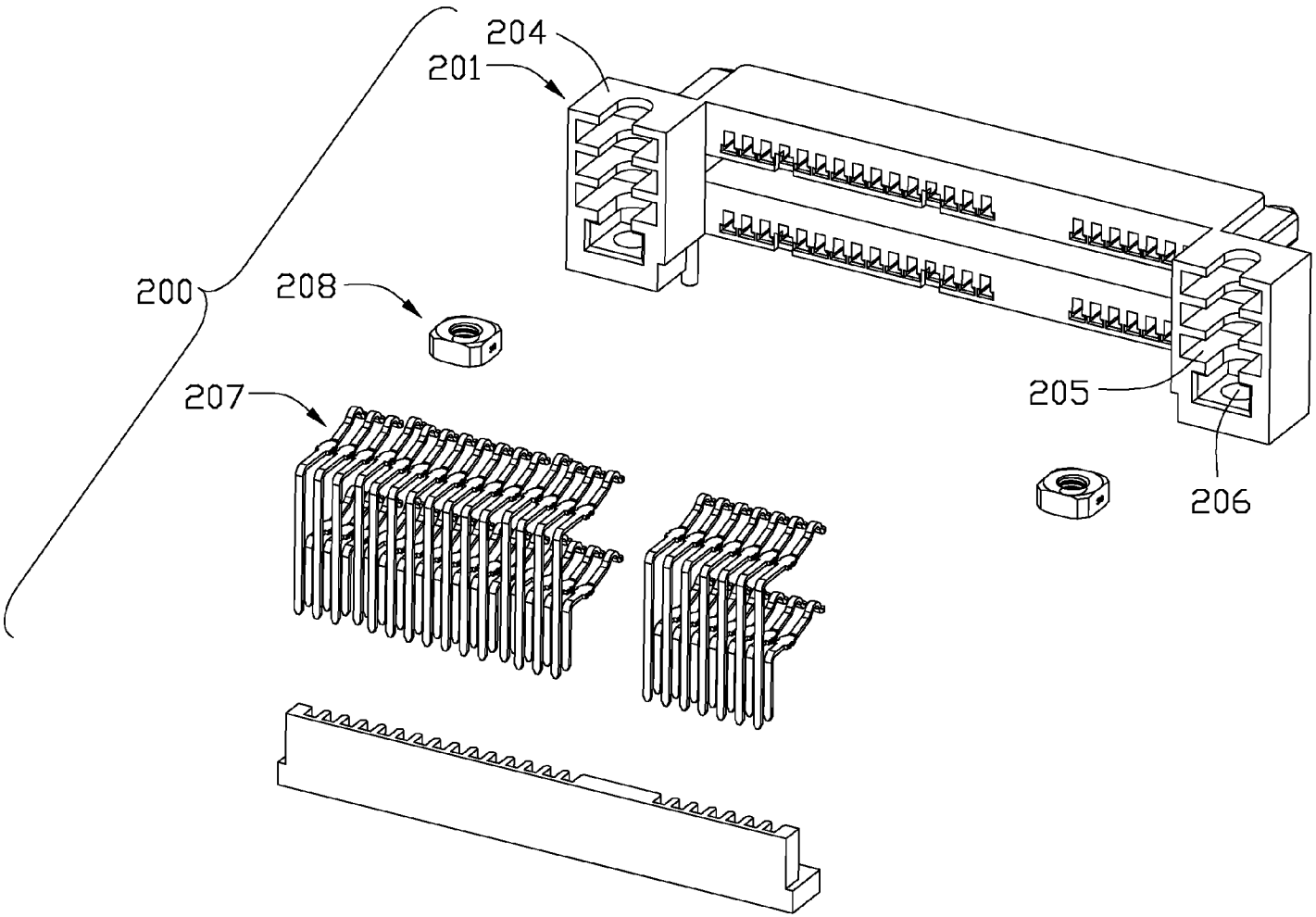
FIG. 6 is an exploded perspective view of the electrical connector as shown in FIG. 5.
Figure 7:
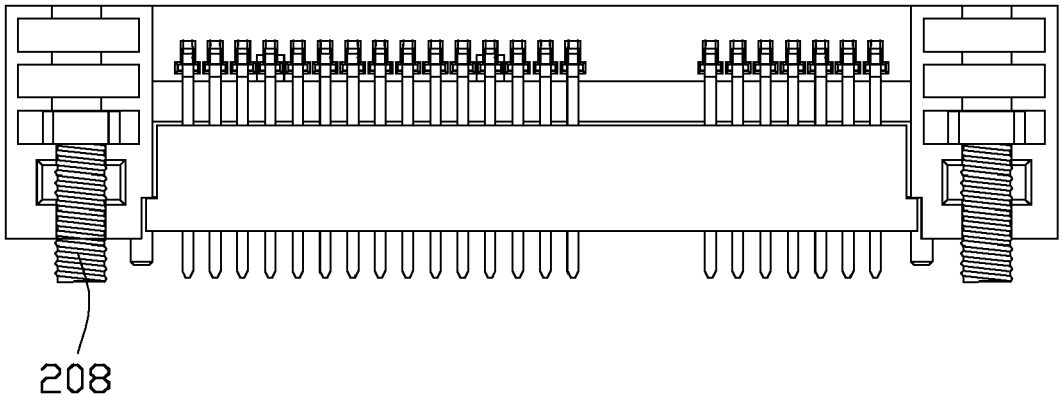
FIG. 7 is a rear side view of an electrical connector of a third embodiment of the present invention.
Figure 8:
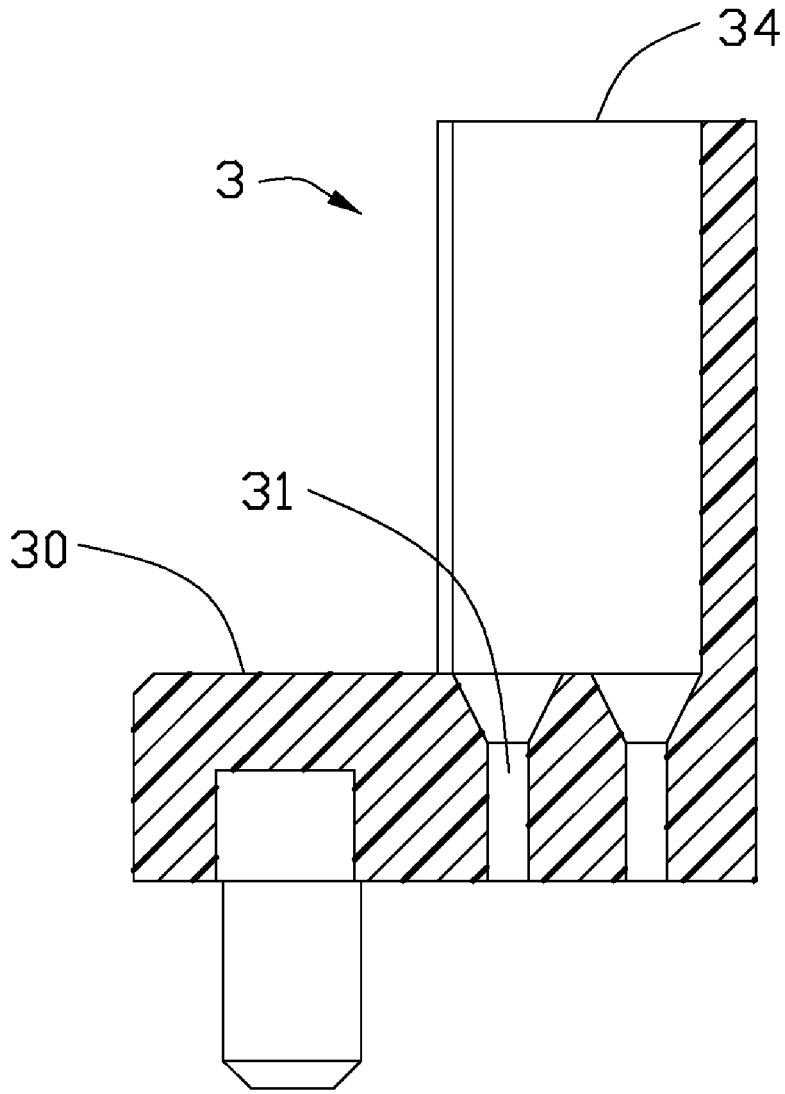
FIG. 8 is a cross-sectional view of the electrical connector taken along lines 8-8 in FIG. 3.

Referring to FIGS. 5 and 7, an electrical connector 200 of a second embodiment includes an insulative housing 201 having a first mating portion 202 and a second mating portion 203 stacked below the first mating portion 202. A pair of mounting portions 204 extends downwardly from the two ends of the first and second mating portion 202, 203 for mounting on a printed circuit board (not shown) and defines at least two mounting recesses 205 stacked up and down and communicated with each other. One of the mounting recesses 205 adjacent to the bottom end of the mounting portion 204 defines a hole 206 extending through the bottom end. A plurality of contacts 207 are secured in a plurality of receiving passageways extending in the insulative housing 201. A pair of securing elements 208 respectively are received in the mounting recesses 205 of the mounting portions 204. In industry the securing element 208 can choose nut (shown FIG. 6) or bolt (shown FIG. 7) disposed in the mounting recesses 205. When the height of the insulative housing 201 is changed, the pair of securing elements 208 needs to dispose in a proproxiate height mounting recesses 205.

What is claimed is:

1. An electrical connector, comprising:

an insulative housing having a mating portion defining a front surface for mating a complementary connector and a back surface opposite to the front surface;

a plurality of contacts secured in the housing and defining soldering tails, the plurality of contacts including a group of first contacts;

a spacer assembled to position the soldering tails and comprising first mounting holes to receive the soldering tails of the first contacts;

wherein the first mounting holes of the spacer are lined in at least two rows in a first direction and each row has a same number of the first mounting holes to a total number of the first contacts, the first mounting holes of each row are aligned along a second direction perpendicular to the first direction;

wherein said soldering tails are arranged in two staggered rows and inserted in every two adjacent first mounting holes;

wherein the contacts comprise contacting portions exposed to the front surface and all contacting portions of the first contacts are lined in one row;

wherein the plurality of contacts further comprise a group of second contacts, the soldering tails of the second contacts are lined in one row, the spacer includes a plurality of second mounting holes in one row to position the soldering tails of the second contacts;

wherein said insulative housing has a pair of mounting portions extending downwardly from the mating portion, each mounting portion defines a plurality of mounting recesses stacked up and down and communicating with each other, and the electrical connector includes a pair of securing elements respectively receiving in the mounting recesses of the two mounting portions.

2. The electrical connector as claimed in claim 1, wherein said spacer has a baffle parallel to the soldering tails of the contacts, a plurality of separators extend forwardly from the baffle for separating from the adjacent soldering tails.

3. The electrical connector as claimed in claim 1, wherein said spacer defines two recesses at two ends thereof, each mounting portion has a cutout adjacent to a bottom end thereof and a tuber projecting from an inner of the cutout and retained in the recess of the spacer.

4. The electrical connector as claimed in claim 1, wherein said mating portion defines an L-shaped slot below the receiving passageways and communicating with the receiving passageways.

5. An electrical connector, comprising:

an insulative housing having a first mating portion defining a front surface and a back surface opposite to the front surface and a pair of mounting portions extending downwardly;

a plurality of contacts secured in the first mating portion;

a pair of securing elements retained in the pair of mounting portions respectively;

wherein each mounting portion defines at least two parallel mounting recesses stacked up and down and communicated with each other, the pair of securing elements are received in one of the at least two mounting recesses depending on a height of the electrical connector on a printed circuit board on which the electrical connector is mounted.

6. The electrical connector as claimed in claim 5, wherein said insulative housing has a second mating portion stacked below the first mating portion and connecting with the two mounting portion.

7. The electrical connector as claimed in claim 6, wherein said first mating portion and the second mating portion both have a pair of guiding portions extending from the two side thereof and a L-shaped mating slot extending rearward through the front face therein.

8. The electrical connector as claimed in claim 7, wherein said electrical connector includes a spacer secured between the two mounting portions to position soldering tails of the contacts.

9. The electrical connector as claimed in claim 4, wherein said mounting recesses open rearwards.

10. An electrical connector for mounting to a printed circuit board, comprising:

an insulative housing including a pair of upstanding towers at two opposite ends in a lengthwise direction, and a mating section located between said pair of upstanding towers in said lengthwise direction and raised up in a vertical direction perpendicular to said lengthwise direction;

a plurality of contacts disposed in the housing along said lengthwise direction, each of said contacts including a mating section exposed in the mating section, and a tail section for mounting to the printed circuit board;

an insulative spacer located between said pair of towers in said lengthwise direction and defining a mounting face essentially close to bottom faces of said pair of towers; wherein said spacer includes a lower part having engagement means exposed to an exterior to couple to the pair of towers for retaining the spacer between and to said pair of towers, and alignment means hidden within an interior and arranged with a plurality of through holes for guiding the tail sections into corresponding holes in the printed circuit board, and said spacer further includes an upper part which includes a plurality of separators to form a plurality of respective grooves each between every adjacent two separators, under condition that each of said grooves is aligned with at least two through holes in a front-to-back direction perpendicular to both said lengthwise direction and said vertical direction.

11. The electrical connector as claimed in claim 10, wherein each of said pair of towers defines a plurality of mounting recesses in said vertical direction for selectively receiving a corresponding nut therein for compliance with a screw with a predetermined length thereof.

12. The electrical connector as claimed in claim 10, wherein said spacer is equipped with a pair of posts adjacent to the corresponding towers, respectively.

13. The electrical connector as claimed in claim 10, wherein each groove receives an upper section of one tail section of only one contact therein under condition that lower sections of said tail sections of said contacts are staggered with one another in said front-to-back direction and received in the corresponding through holes.

14. The electrical connector as claimed in claim 13, wherein some of the through holes are empty with the corresponding tail sections extending therethrough.

* * * * *